US010344427B2

(12) United States Patent
Coutaz et al.

(10) Patent No.: US 10,344,427 B2
(45) Date of Patent: Jul. 9, 2019

(54) METHOD FOR PRODUCTION OF A CLOSED-LOOP CABLE BY SPLICING

(71) Applicant: ARCELORMITTAL WIRE FRANCE, Bourg en Bresse (FR)

(72) Inventors: Benjamin Coutaz, Ceyzeriat (FR); Marc Courtebras, Feillens (FR); Pierre-François Baron, Saint Denis les Bourg (FR)

( * ) Notice: Subject to any disclaimer, the term of this patent is extended or adjusted under 35 U.S.C. 154(b) by 662 days.

(21) Appl. No.: 14/878,770

(22) Filed: Oct. 8, 2015

(65) Prior Publication Data

US 2016/0024710 A1 Jan. 28, 2016

Related U.S. Application Data

(63) Continuation of application No. 14/419,121, filed as application No. PCT/FR2012/000330 on Aug. 3, 2012, now abandoned.

(51) Int. Cl.

| | |
|---|---|
| ***D07B 7/16*** | (2006.01) |
| ***D07B 1/16*** | (2006.01) |
| ***D07B 7/18*** | (2006.01) |

(52) U.S. Cl.

CPC ..... *D07B 7/169* (2015.07); *D07B 1/165* (2013.01); *D07B 7/165* (2013.01); *D07B 7/182* (2015.07); *D07B 2201/102* (2013.01); *D07B 2201/2044* (2013.01); *D07B 2201/2049* (2013.01); *D07B 2201/2053* (2013.01); *D07B 2401/205* (2013.01); *D07B 2401/403* (2013.01); *D07B 2501/2076* (2013.01)

(58) Field of Classification Search

CPC ..... D07B 7/167; D07B 7/169; D07B 7/185; D07B 9/00; D07B 1/165

See application file for complete search history.

(56) References Cited

U.S. PATENT DOCUMENTS

| | | | | | |
|---|---|---|---|---|---|
| 1,055,326 | A | * | 3/1913 | Gore | D07B 1/0686 57/220 |
| 2,216,922 | A | * | 10/1940 | Naysmith | D07B 7/165 57/21 |
| 3,634,972 | A | * | 1/1972 | Illman | B60C 9/0028 57/202 |
| 3,904,458 | A | * | 9/1975 | Wray | B29C 65/68 156/158 |
| 3,934,397 | A | * | 1/1976 | Black | D07B 7/165 57/202 |

(Continued)

FOREIGN PATENT DOCUMENTS

| | | | |
|---|---|---|---|
| CN | 1668804 | A | 9/2005 |
| CN | 1708446 | A | 12/2005 |

(Continued)

*Primary Examiner* — Shaun R Hurley

(74) *Attorney, Agent, or Firm* — Davidson, Davidson & Kappel, LLC

(57) ABSTRACT

The present invention provides a production method for a closed-loop cable. The method includes the steps of providing a cable including a core and metal strands helically wound around the core, connecting two ends of the cable in splice areas via splice knots formed by ends of each metal strand, inserting the metal strand ends inside the cable after locally removing the core and subsequently overmolding each splice area using a polymer.

17 Claims, 3 Drawing Sheets

(56) References Cited

U.S. PATENT DOCUMENTS 4,428,992 A * 1/1984 Street ..... B65H 69/02 156/158
4,509,319 A * 4/1985 Yoshida ..... D07B 1/0686 57/213
5,669,214 A * 9/1997 Kopanakis ..... D07B 1/167 57/218
6,381,939 B1 * 5/2002 Brown ..... B66C 1/12 24/122.6
7,107,749 B2 9/2006 Wetzels et al.
7,389,633 B2 * 6/2008 Misrachi ..... D07B 1/165 57/223
7,426,821 B2 * 9/2008 Soenen ..... B23K 1/0008 57/236
7,600,366 B2 * 10/2009 Furukawa ..... D07B 1/0673 57/212
7,775,028 B2 * 8/2010 Sasabe ..... B21F 15/06 57/201
7,856,803 B2 * 12/2010 Ozmerzi ..... B65H 69/00 57/202
8,793,843 B2 * 8/2014 Khachaturian ..... B66C 1/12 24/122.6
2003/0220165 A1 * 11/2003 He ..... F16G 1/28 474/203
2005/0070793 A1 3/2005 Pacetti et al.
2005/0229770 A1 * 10/2005 Smeets ..... D04C 1/12 87/8
2005/0257874 A1 * 11/2005 Soenen ..... B23K 1/0008 156/47
2006/0048494 A1 * 3/2006 Wetzels ..... D07B 7/18 57/22
2006/0260287 A1 * 11/2006 Misrachi ..... D07B 1/165 57/210
2009/0088278 A1 4/2009 Sasabe et al.
2009/0136697 A1 * 5/2009 Sano ..... D07B 1/0673 428/36.3
2010/0170214 A1 * 7/2010 Ozmerzi ..... B65H 69/00 57/200
2012/0148838 A1 * 6/2012 Miura ..... B29B 9/14 428/364
2013/0145740 A1 * 6/2013 Schulz ..... D07B 1/185 57/231

FOREIGN PATENT DOCUMENTS

DE 2852757 A1 6/1979
DE 3237733 4/1984
DE 3245779 6/1984
FR 2724398 3/1996
JP S6417780 A 1/1989
JP H03157539 A 7/1991
JP H05147829 A 6/1993
JP 2011132620 A 7/2011
SU 211973 A 11/1968
SU 421828 A 3/1974
WO 2008029857 A1 3/2008
WO 2013156689 10/2013

* cited by examiner

METHOD FOR PRODUCTION OF A CLOSED-LOOP CABLE BY SPLICING

CROSS REFERENCE TO RELATED APPLICATIONS

This is a continuation of U.S. application Ser. No. 14/419,121 filed on Feb. 2, 2015, which is a national stage of International Application No. PCT/FR2012/000330 filed on Aug. 3, 2012, the entire disclosures of which are hereby incorporated by reference herein.

The present invention relates to a method for producing a closed-loop cable by splicing and also the resulting closed-loop which is more specifically intended to be incorporated in a cable transportation installation using hauling or carrying-hauling cables, without being limited to them.

BACKGROUND

To produce such a closed-loop cable, it is necessary to make a splice serving to join the two ends thereof. Such a splice involves closing the cable on itself on both sides of the marrying area by re-laying half of the strands coming from each of the cable ends thus joined and then making a knot between each of the pairs of aligned strands, and then inserting each of the knotted strands in the place of the previously, locally removed core of the cable in the corresponding splice areas.

In connection with the present invention, splice area is understood to mean the area comprising a splice knot and the two cable portions immediately adjacent to this knot, along which the two knotted strands have been tucked into the space of the cable core.

According to the state of the art, the splice therefore inevitably comprises a localized geometric irregularity which generates vibrations at various levels and, in particular:

near the knots made among the aligned strands constituting the cable, taken pairwise near the distribution of the play between the outside strands on either side of the aforementioned knots, along the areas where the knotted strands are tucked in place of the core;

or also near the end of each of these tucked areas.

In fact, the area of the splice moving over each roller of the installation generates a movement thereof which can reach an amplitude of several millimeters. As can be seen, depending on the speed of passage of the cable, each of the rollers of the installation will therefore find itself either affected by a series of isolated movements upon the passage of each geometric irregularity of the splice or driven by a periodic oscillation whose frequency, depending on the case, could be several tens of Hertz or even in some cases several hundreds of Hertz.

These vibrations, whose generation is inherent in the splicing of hauling or carrying-hauling cables according to the state of the art, can however be such that they disrupt the environment (e.g., generation of noise near residences) and/or accelerate the wear or fatigue of some of the components thereof and in particular of the cable itself or of the components of the device in which the cable loop is used.

This situation is especially encountered at cable transportation installations, whether for people or materials, that frequently operate at a very high service rate and whose expected lifetime is generally several tens of years.

SUMMARY OF THE INVENTION

An object of the present invention is therefore to remedy these disadvantages by proposing a splicing method with which to obtain a closed-loop cable having a splice of great geometric regularity in order to very significantly reduce or even completely eliminate vibrations generated by this area and to extend the lifetime of this cable.

The present invention provides a production method for a closed-loop cable where said cable comprises a core and metal strands helically wound around said core, in which the two ends of said cable are connected in splice areas in which splice knots are formed with the ends of each of said strands, that are next tucked inside said cable after having locally removed the core where each splice area is subsequently overmolded using a polymer.

The process according to the invention can additionally incorporate the following features, taken alone or in combination:

the overmolding is done partially, such that the upper part of the strands are not covered with the polymer;

prior to performing the overmolding, the existing play between the strands at each splicing area is uniformly distributed;

the play is distributed by inserting spacers shaped for this purpose between each strand;

the spacers have an outer surface that holds the polymer in place after performing the overmolding;

the ends of the strands to be tucked in place of the core on either side of the splice knots are shortened, such that there is a free volume between the ends and the core once the ends are tucked inside the cable—this volume is later filled with polymer during the overmolding;

the overmolding is done using a two-component heat-curing polymer the overmolding is done using a mold with cylindrical internal volume;

prior to inserting them inside the cable, the ends of the strands are dressed by overmolding them with a polymer;

the cable includes a unitary core comprising a central nucleus and uniformly distributed fins between which the strands are inserted, with overmolding of the splice areas serving to rebuild the fins in the splice areas.

The present invention also provides a production method for a closed-loop cable where said cable comprises a core and metal strands helically wound around said core, in which the two ends of said cable are connected in splice areas in which splice knots are formed with the ends of each of said strands, that are next tucked inside said cable after having locally removed the core and in which the ends of said strands are dressed by overmolding them using a polymer prior to inserting them inside said cable.

A closed-loop cable obtained according to the production methods of the present invention is further provided.

The use of a closed-loop cable according to the present invention as pure hauling cable or as carrying-hauling cable is additionally provided.

BRIEF DESCRIPTION OF THE DRAWINGS

The present invention will be better understood using the following description given solely as an example and with reference to the attached drawings, in which.

DETAILED DESCRIPTION

Figure 1:
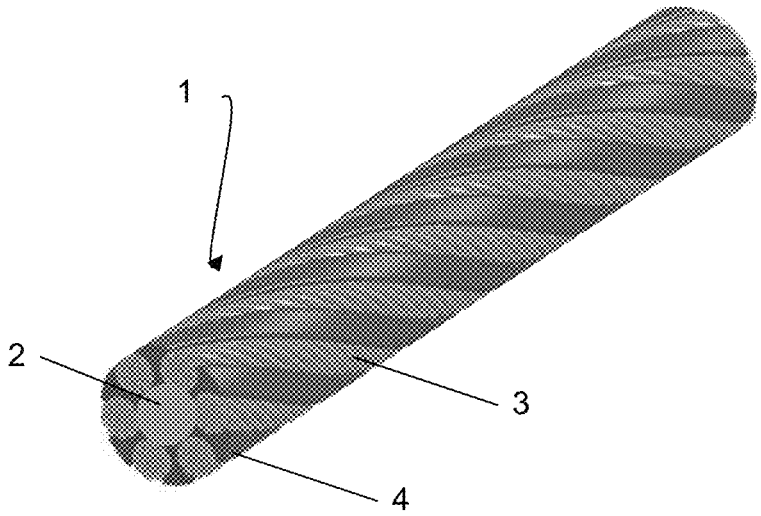
FIG. 1 is a perspective view of the cable cut before splicing.

The closed-loop cable production method according to the invention can advantageously be used for splicing a hauling cable comprising a unitary core carrying several outer strands constituted of steel wires, where the number of these strands is most often six, made according to patent application PCT/FR12/000152 in the name of the applicant and will be described below with reference to this application for illustration but without limitation.

In connection with the present invention, a closed loop will designate an endless loop obtained by splicing one end of a cable to the other end of the same cable where these two ends are brought face-to-face. This term does not particularly cover cables having an end loop, such as a sling, for example.

Essentially, the splice therefore consists of "marrying" the two ends of a cable by replacing in each of them, in case of an even number of strands, half of the strands of one by the strands of the other and vice versa and by inserting the end of the strands inside the cable in an area where the core was previously removed, after having previously made a knot between each pair of aligned strands. In case of an odd number of strands, in one of the cable ends to be joined a greater number of strands will be replaced from one than from the other, where the two numbers of strands replaced in each of the ends corresponds to the two consecutive integer numbers bracketing the value equal to half of the number of strands in the cable. Because of the execution of the knots between pairs of aligned strands and to a lesser extent because of the tucking of the knotted strands inside the cable, various more or less localized increases of diameter are produced which can reach up to 10% of the nominal cable diameter, where the current state of the art demands that this value not be exceeded.

The full splicing operation generally requires some 10 operators.

In detail, the production of a closed-loop cable by splicing conventionally starts by the preparation of two areas of the cable needing to be joined by binding each of the ends. This binding is generally done with the help of metal wires positioned respectively at the middle of the estimated length of the splicing area, in order to precisely position the area for "marrying" the two cable ends. The person skilled in the art knows how to determine this length based, especially, on the cable diameter. For lift facilities, the total length of the splice is equal to 1200 times the nominal cable diameter. Thus, for a 54 mm diameter cable, that represents a length of nearly 65 m, for example.

Once the binding is done, the marrying of the two cable ends is done over one or more cable windings, and then a soft jaw is placed on the marrying area in order to avoid any movement of the two cable ends during splicing; the two ties are removed and from each cable end every other strand is unwound while replacing it with the aligned strand coming from the other cable end and this is done out to the position selected by the splicer for the position of each knot—for both cable ends—and then the end of each strand is straightened along the length intended to be tucked-in in place of the core.

Each of the aligned strands is then knotted to the aligned strand coming from the other cable end in order to form as many splice knots as there are aligning pairs of strands. In the distribution of these knots formed over the entire length, it is important to follow the precise positions chosen in advance, since each knot is generally several meters away from the neighboring knots.

On either side of each of the splice knots, each of the strand ends is then tucked inside the cable where they take the place of the core which will have intentionally been previously removed along the corresponding cable portion.

In order that the outer strands have a good support, the strands tucked-in in place of the core must be covered with a dressing which generally consists of an adhesive textile that had been bonded.

Now referring to cable 1 made according to application PCT/FR12/000152 and as shown in FIG. 1, it can be seen that it includes a unitary core 2 extended by six fins 4 between which six strands 3 have been inserted. The strands 3 can conventionally be made up from an assembly of wires of various diameters helically wound around a central wire. They are preferably metal and more specifically preferably steel. The central part of the core of the cable can additionally include a strand. This strand can conventionally be made up from an assembly of wires of various diameters helically wound around a central wire. It is preferably metal and more specifically preferably steel. Finally, the core of the cable can also include fibers, metallic or not, inserted longitudinally in the core.

Cable 1 has in the end a substantially cylindrical outer surface for the purpose of minimizing vibrations and noise generated by the passage of the cable over the guiding rollers and in general over the winding members of the installation in which it is used.

Because of the use of the core 2 and fins 4, the center to center distance between adjacent strands 3 therefore turns out to be larger within this type of cable than in the hauling or carrying-hauling cable of conventional construction according to the state of the art.

Consequently, at equal metal section, the diameter of the ordinary part of cable 1 turns out to be slightly larger than that of a hauling or carrying-hauling cable of conventional construction, which allows, once the loop is under tension and contrary to what is possible when performing a splice on a hauling or carrying-hauling cable of conventional construction, to obtain, at the finished knots between pairwise aligned strands, a diameter that is near, or even equal, to that of the cable under tension outside of the splice area.

In order to further improve the geometric regularity of the splice, an aspect of the invention includes adding a step of overmolding to each splice area using a polymer such as a two-component heat-curing polymer, for example an appropriate grade of polyurethane. Another aspect of the invention, which will be described in more detail, consists of adding a step of overmolding around each of the strands to be tucked-in on opposite sides of the knots to be made pairwise between aligned strands. Each aspect of the invention can be implemented separately or in combination, in particular, the overmolding of each of the strands to be tucked in can advantageously be used during splicing of carrying or carrying-hauling cables according to the state of the art.

Because of the overmolding of each of the splice areas, the most cylindrical possible surface, in so far as possible, can thus be reconstituted on the full length of each splice area, thereby improving the geometric regularity of the cable and thus the performance thereof.

Figure 4:
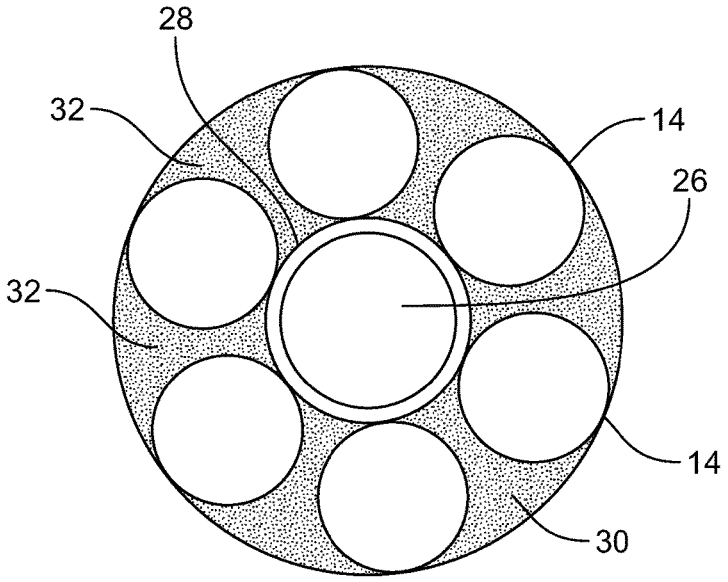
FIG. 4 shows a cross section of the cable with rebuilt fins.
Figure 5:
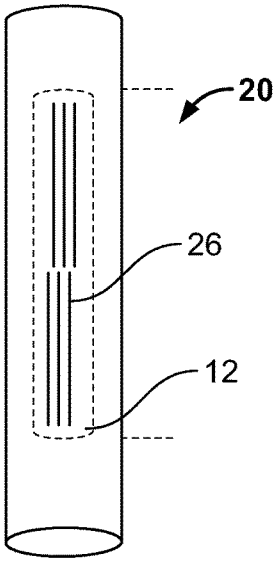
FIG. 5 shows a splice area of the spliced cable after splicing.
Figure 6:
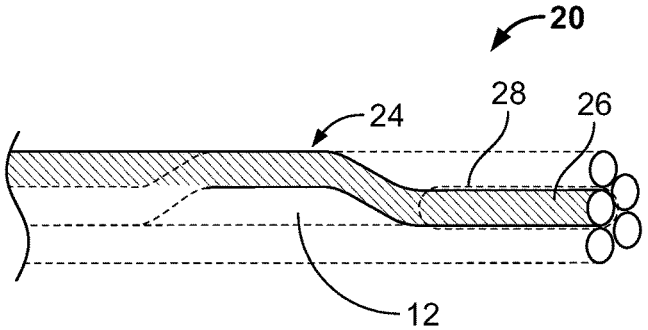
FIG. 6 shows a splice knot in the splice area of the cable.

As shown in FIGS. 4 to 6, cy overmolding the splice area 20, the fins 4 in these areas can be as much as possible rebuilt, rebuilt fins 32 (FIG. 4), in order to obtain a substantially cylindrical surface characteristic of this type of product, thus guaranteeing at each point of the splice areas 20 an external geometry of these areas equivalent or very close to that of the cable in the ordinary part.

In a preferred embodiment, the splice area 20 is partially overmolded such that the upper portion of the strands 14 is not covered by this polymer 30, which avoids increasing the diameter thereof.

In a preferred embodiment, in each of the splice areas 20 where each of the pairwise aligned strands is tucked-in in place of the previously removed core 12 once the corresponding knot 24 is made, the play is uniformly distributed between adjacent strands before going ahead with the overmolding 30 of the splice areas 20.

Figure 2:
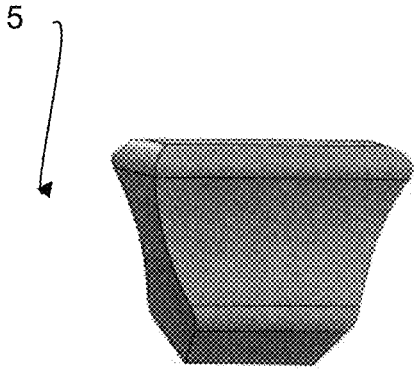
FIG. 2 is a perspective view of a play distribution spacer which can be used in the method according to the invention.
Figure 3:
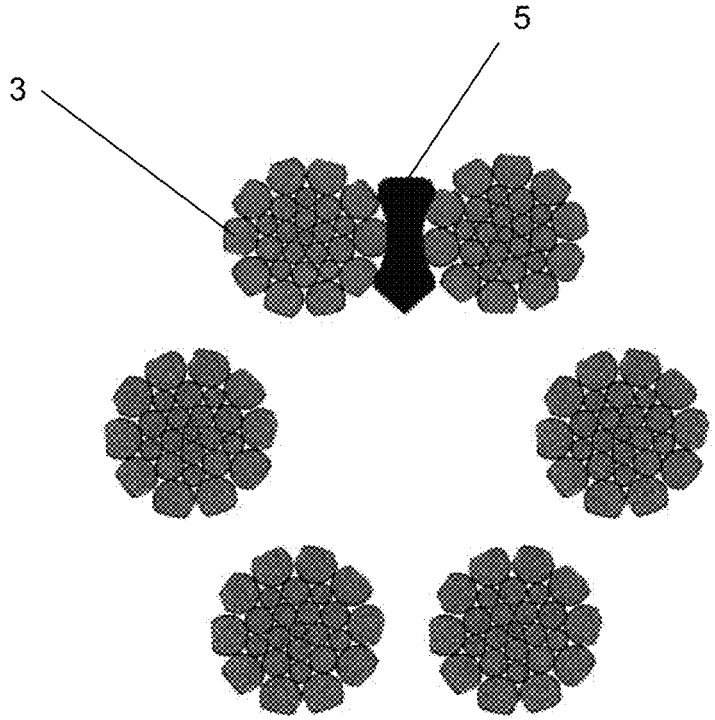
FIG. 3 is a schematic cross-section view of the cable with insertion of the distribution spacer corresponding to FIG. 2.

This uniform distribution can, for example, be advantageously obtained along each of the aforementioned areas by the insertion, at uniform intervals and as close together as necessary, play distribution spacers or dual-throat spacers 5 such as can be seen in FIG. 2 which shows one and also in FIG. 3 where its insertion between two strands 3 can be seen. For example, the spacers can be inserted every 10 to 25 cm.

The spacers 5 can comprise the following functional parts:

a double chamfer on the lower part to make it easier to insert them between the adjacent strands that they are going to space, and a throat on each side in the median portion thereof where each of these throats is intended to receive one of the two adjacent strands they are going to space so as to obtain the pinching of the corresponding spacer between the aforementioned two strands.

In a preferred embodiment, the spacers 5 can additionally comprise two inclined ends having a trapezoidal shape in side view, where the small dimension thereof is located on the side the aforementioned double chamfer, such that each of the spacers forms a dovetail for retaining the overmolding of the splice areas according to the invention.

The spacers are made of a material that is sufficiently hard and resistant over time, for example of metals that are not as hard as the steel of the wires making up the cable or of polymers, whether or not they are comprised of fillers intended to increase the compressive strength and/or wear resistance or else to give them lubricating properties.

Furthermore, in the state of the art, each of the strands to be tucked in is cut to the necessary length before being fully tucked in so as to come as exactly as possible, once tucked-in in place of the previously removed core 12, in contact in the longitudinal direction with the portion of the core remaining in the cable length adjacent to the tucked-in area in question.

However, despite all the care given to the precision of cutting the strand to be tucked in to length, it is very difficult to cut it exactly to the desired length, the result of which is either a kind of stuffing during the placement thereof if it is cut slightly too long, or, if it is cut too short, a lack of support for the outer strands over a length which can reach up to several millimeters resulting in a localized reduction of the cable diameter, or even a more or less severe contact between adjacent outer strands which could lead to the premature appearance of many broken wires in this area.

In a preferred embodiment, the strands to be tucked-in are cut by choice to a slightly shorter length 26, for example by a few millimeters, than the space available for tucking them in in place of the previously removed core 12. (FIGS. 5 and 6).

The small volume thus released at the end of the tucked-in strand is thus easily available for being totally filled during the pouring of the polymer 30 for overmolding the corresponding splice area 20, which thus serves to get an optimal support for the outer strands near the end of the strand tucked-in in place of the core.

In another preferred embodiment, the step of dressing the ends of the strands can furthermore be greatly improved over the state of the art by placing a specific dressing 28 around each of the strands 26 to be tucked in on both sides of the knots to be made between pairwise aligned strands.

This specific dressing is obtained by overmolding of an adequate material around each of the strands. For this purpose, two-component heat-cured polymers, for example a suitable grade of polyurethane, whose fluidity before setting needs to be sufficient for easily filling a mold which had been tightened around the entire length of the strand to be dressed, can especially be used.

Additionally, the material used for overmolding should have a hardness and final mechanical strength for supporting over time the pressure exerted by the strands bearing on the overmolded dressing once the splice is made.

Whether it involves the mold for the splicing areas or for overmolding the dressing, the molds used can have one or more parts. They can thus be made, for example, in the form of opposing trays provided with lateral and terminal flanges intended to rigidly connect them so as to form a mold with a single cylindrical inside volume and will preferably define a cylindrical inside volume.

The polymer materials used for these overmoldings can be, for example, two-component heat-curing polymers, such as appropriate grade polyurethanes.

Vents allowing the pouring of liquid phase polymer can also be made in the upper part of the molds.

Additionally, the mold can comprise a heating system intended to accelerate the setting and solidification of the two-component heat-curing polymers that can be used for the various types of overmolding described above. This heating system can be an integral part of these molds or else consist of a heating system to be placed around the molds themselves.

Molds intended to overmold the strands to be inserted in place of the core preferably comprise spikes or studs for centering the strand to be overmolded so as to assure that the overmolding is concentric therearound.

Molds intended for overmolding splice areas can be provided with a flexible material (for example a polymer of suitable hardness) intended to assure tightness during flowing of the polymer for overmolding while coming into contact with each of the outer strands of the cable so as to allow them to slightly come out of the overmolding material.

The closed-loop cable according to the invention is more specifically intended to be incorporated as pure hauling cable or is carrying-hauling cable in an installation for transporting people by cables, such as a gondola lift or aerial tramway.

Beyond these applications, the closed-loop cable according to the invention could be used in many other applications such as an urban transportation system, for example, and therefore not be limited to the aforementioned uses.

Although the method according to the invention has been illustrated preferentially using the cable according to the application PCT/FR12/000152, it goes without saying that application thereof to splicing of other hauling or carrying-hauling cable types is of course possible and also suited to improve the lifetime of the cables thus formed while also reducing a part of the inevitable geometric irregularities of their splice. It is therefore also covered by the invention.

Finally it will be noted that the method from the present invention serves to make splices that comply in all points with the harmonized standard EN 12927-3 (Safety requirements for cableways installation designed to carry persons. Cables. Part 3: Splicing of 6-strand hauling, carrying hauling and towing cables).

What is claimed is:

1. A production method for a closed-loop cable comprising the steps of:

providing a cable including a core and metal strands helically wound around the core, the cable having a first end and a second end;

splicing the first and second ends of the cable together by connecting the first and second ends of the cable in splice areas via splice knots formed by ends of each metal strand;

inserting at least one metal strand from the first end inside the second end of the cable after locally removing the core; and subsequently overmolding each splice area using a polymer, the polymer contacting one of the metal strands.

2. The method according to claim 1, wherein the overmolding does not cover an outer part of the strands with the polymer.

3. The method according to claim 1, wherein prior to the step of overmolding, existing play between the metal strands at each splicing area is uniformly distributed.

4. The method according to claim 3, wherein the play is distributed by inserting spacers between each strand.

5. The method according to claim 4, wherein the spacers have an outer surface that holds the polymer in place after the step of overmolding.

6. The method according to claim 1, wherein the metal strand ends inserted in place of the core on either side of the splice knots are shortened so there is a free volume between the metal strand ends and the core when the metal strand ends are inserted inside the cable, the free volume being filled with polymer during overmolding.

7. The method according to claim 1, wherein overmolding is done using a two-component heat-curing polymer.

8. The method according to claim 1, wherein the overmolding is done using a mold with a cylindrical internal volume.

9. The method according to claim 1, further comprising the step of:

dressing the metal strand ends by overmolding the metal strand ends using a polymer prior to inserting the metal strand ends inside the cable.

10. The method according to claim 1, wherein the core comprises a central nucleus and uniformly distributed fins extending from the central nucleus between which the metal strands are arranged, with overmolding of the splice areas serving to rebuild the fins in the splice area.

11. A closed-loop cable obtained by the method according to claim 1.

12. A pure hauling cable or carry-hauling cable comprising:

the cable recited in claim 11.

13. A production method for a closed-loop cable comprising:

providing a cable with a core and metal strands helically wound around the core;

connecting two ends of the cable in splice areas via splice knots formed with the ends of each metal strand;

inserting the metal strand ends inside the cable after locally removing the core; and dressing at least one of the metal strand ends individually by overmolding with a polymer prior to inserting the metal strand ends inside the cable.

14. A closed-loop cable obtained by the method according to claim 13.

15. A pure hauling cable or carry-hauling cable comprising:

the cable recited in claim 14.

16. The method according to claim 1, further comprising the step of:

inserting at least one metal strand from the second end inside the first end of the cable after locally removing the core.

17. A production method for a closed-loop cable comprising the steps of:

providing a cable including a core and metal strands helically wound around the core, the cable having a first end and a second end;

splicing the first and second ends of the cable together by connecting the first and second ends of the cable in splice areas via splice knots formed by ends of each metal strand;

inserting at least one metal strand from the first end inside the second end of the cable after locally removing the core;

subsequently overmolding each splice area using a polymer to fill a void remaining from the removal of the core.

* * * * *